US009810424B2

(12) United States Patent
Perez Corral

(10) Patent No.: US 9,810,424 B2
(45) Date of Patent: Nov. 7, 2017

(54) SYSTEM FOR CLEANING THE BURNER AND CONFINING FUEL IN SOLID-FUEL BOILERS

(71) Applicant: Caldereria Quintin, S.L., Arrankudiaga (Vizcaya) (ES)

(72) Inventor: Camilo Perez Corral, Arrankudiaga (ES)

(73) Assignee: CALDERERIA QUINTIN, S.L., Arrankudiaga (Vizcaya) (ES)

( * ) Notice: Subject to any disclaimer, the term of this patent is extended or adjusted under 35 U.S.C. 154(b) by 241 days.

(21) Appl. No.: 14/746,185

(22) Filed: Jun. 22, 2015

(65) Prior Publication Data

US 2016/0091198 A1 Mar. 31, 2016

(30) Foreign Application Priority Data

Sep. 25, 2014 (ES) ..... 201431401

(51) Int. Cl.

| | |
|---|---|
| ***F23B 30/00*** | (2006.01) |
| ***F23J 1/00*** | (2006.01) |
| ***F23B 30/02*** | (2006.01) |
| ***F23B 40/04*** | (2006.01) |
| ***F23H 15/00*** | (2006.01) |

(52) U.S. Cl.

CPC ..... *F23B 1/24* (2013.01); *F23B 30/02* (2013.01); *F23B 40/04* (2013.01); *F23H 15/00* (2013.01); *F23J 1/00* (2013.01)

(58) Field of Classification Search

CPC ... F23J 1/00; F23H 15/00; F23B 40/04; F23B 30/02; F23B 1/24

USPC ..... 126/242, 244, 173, 182; 110/247, 275

See application file for complete search history.

(56) References Cited

U.S. PATENT DOCUMENTS

| | | | | |
|---|---|---|---|---|
| 728,362 | A * | 5/1903 | Butman | F22B 31/04 110/275 |
| 3,611,542 | A * | 10/1971 | Moore | F23G 7/00 110/247 |
| 4,437,452 | A | 3/1984 | Reschly | |
| 2009/0056694 | A1 * | 3/2009 | Lin | F23H 15/00 126/244 |

FOREIGN PATENT DOCUMENTS

| | | | |
|---|---|---|---|
| CH | 182329 | A | 2/1936 |
| EP | 2039993 | A2 | 3/2009 |

* cited by examiner

*Primary Examiner* — Avinash Savani
*Assistant Examiner* — Rabeeul Zuberi
(74) *Attorney, Agent, or Firm* — Lucas & Mercanti, LLP

(57) ABSTRACT

System for cleaning the burner and confining fuel in solid-fuel boilers of the type that consist of one plate, one supply device, at least one ash discharging device. The plate is mobile and has means to rotate with respect to the supply device and/or to each ash discharging device; each ash discharging device is fixed and has at least one blade with means to guide it at will on the plate occupying at least part of its perimeter. The blades of each ash discharging device are increased in height and occupy the entire perimeter of the plate, all of them delimiting, in conjunction with the plate and in an initial position where they act as side slats, a perimetrally closed container to confine a larger quantity of solid fuel on the plate without varying its size.

4 Claims, 6 Drawing Sheets

SYSTEM FOR CLEANING THE BURNER AND CONFINING FUEL IN SOLID-FUEL BOILERS

CROSS REFERENCE TO RELATED APPLICATION

This Application claims the priority of Spanish Patent Application No. P201431401 filed on Sep. 25, 2014, which is incorporated by reference herein.

OBJECT OF THE INVENTION

The object of the invention, in general, falls within the industrial sector of solid-fuel boilers and, in particular, refers to a system for a) cleaning all or part of the surface of the burner plate, removing the remains of ashes that accumulate in it; performing this total or partial cleaning with no need to disassemble the burner or stop the operation of the boiler; and b) confining the solid fuel in the burner so that the plate accepts a larger amount of fuel without varying its size.

BACKGROUND OF THE INVENTION

In the current state of the art boilers using solid fuels are already known, and in particular, boilers that use solid fuels of small size such as chips, olive stones and, in general, small cylinders of compacted biomass, known generically as "pellets".

The use of these fuels, due to their compact constitution and their reduced size, is advantageous as compared to certain other solid fuels of larger size, allowing the automation of the supply to the biomass boilers from a storage silo.

Also known are biomass boilers that use "pellets" as fuel and incorporate a system for cleaning the ashes that accumulate in the burner. For example, and among others, in documents CH182329, U.S. Pat. No. 4,437,452 and EP2039993 boilers of this type are described.

Unresolved problems in these types of boilers are those relating to the cleaning of the ashes in the burner plate when cleaning is required, not only of the edge, but also of all or most of the burner plate to prevent the ashes from becoming embedded and they accumulate in the burner affecting the performance of the boiler negatively.

Moreover, the power of the boiler is a direct function of the quantity of solid fuel that the burner accepts. In any of the currently known solutions, the quantity of solid fuel that the burner accepts is determined by its own dimensions. To increase the power of the boiler, very large plates are needed.

DESCRIPTION OF THE INVENTION

The object of the invention is a system for cleaning at will all or part of the surface of the burner and confining the solid fuel in the burner in such a way that the plate accepts a larger quantity of fuel without varying its size. The solid-fuel boiler is of the type that consist of a burner plate associated with a combustion chamber; a supply device that supplies the solid fuel from a storage hopper to the centre of the plate through an intake line using controlled/automated dosing; and an ash discharging device associated with a collector on which said ashes overflow from the perimeter of the plate. It is characterized in that the plate is mobile and has means for rotating with respect to the supply device and/or the ash-discharging device; and the ash-discharging device is fixed and has at least one blade with means to guide it at will on the plate.

In the joint action of the mobile plate and fixed ash discharging device, starting from a tangential position in which its blades are arranged on the perimeter of the plate, the ashes deposited can be cleaned by sweeping; they occupy a crown of any width between a minimum (corresponding with the blades positioned very near the edge of the plate) and a maximum (corresponding with the blades positioned occupying the full width of the plate).

It is also characterized in that the blades of the ash discharging device are increased in height, all of them delimiting (in conjunction with the plate and in a tangential position in which they act as side slats) a perimetrally closed container to confine the solid fuel; so that the plate accepts a larger quantity of fuel without varying its size.

Other configurations and advantages of the invention can be deduced from the following description, and from the dependent claims.

DESCRIPTION OF THE DRAWINGS

To understand the object of the invention better, a preferential form of embodiment is represented in the attached figures, subject to accessory changes that do not essentially alter it. In this case.

PREFERENTIAL EMBODIMENT OF THE INVENTION

Figure 1:
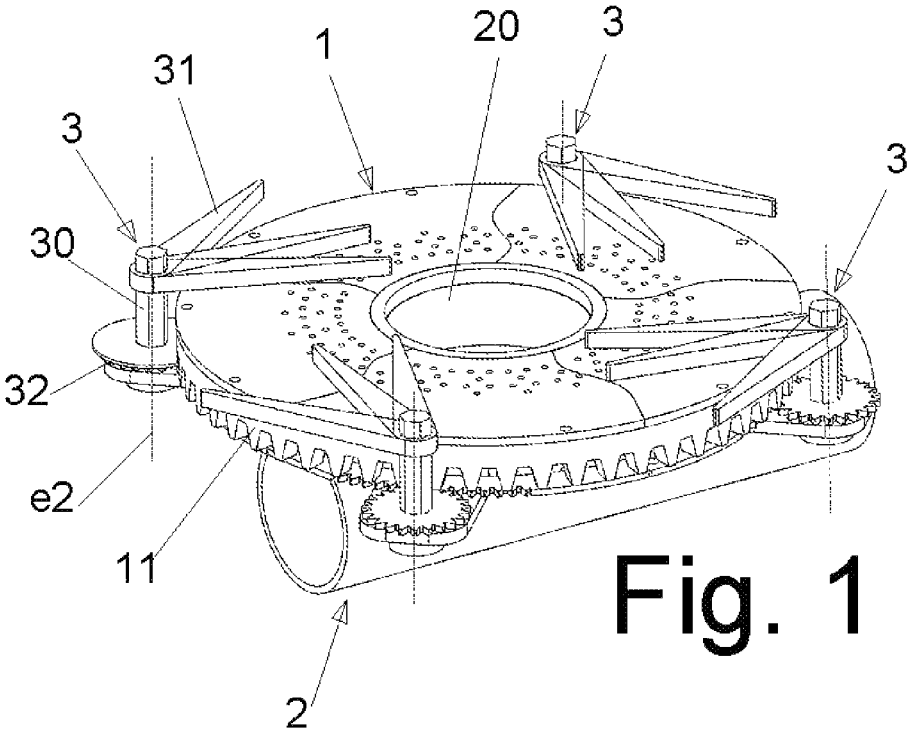
FIG. 1 represents a general view in perspective of a burner equipped with the ash discharging device (3) used to clean all or part of the surface of the plate (1) according to the invention, in which the movement of the blades has been schematized (31).

The following describes an example of practical, non-limiting embodiment of this invention. Other modes of embodiment in which accessory changes are introduced that do not essentially change it are not ruled out.

In the drawings of this example of preferential embodiment, the following references and particularities have been indicated:

1.—burner plate e1.—theoretical axis of the plate

2.—solid fuel supply device

20.—intake line

21.—endless helix/screw
3.—ash-discharging device
30.—physical axis
31.—cleaning blades
310.—head of the blades
311.—wings of the blades
e2.—theoretical axis of the blades
32.—pinion The object of the invention is a system for cleaning the burner and confining fuel in solid-fuel boilers of the type that use solid fuels such as chips, olive stones and, in general, small cylinders of compact biomass known generically as "pellets".

In a known way, these boilers consist of a plate (1) of the burner associated with the combustion chamber; a supply device (2) that supplies the solid fuel from a storage hopper using controlled/automated dosing; and an ash-discharging device (3) associated with a collector on which said ashes overflow from the perimeter of the plate (1).

The solid fuels used reach the burner (1) using, for example, a supply device (2), of the helix or endless screw type (21) that supplies them, at controlled speed, from a storage hopper, accessing a central zone of the plate (1) through an intake line (20).

Also in a known way, the ashes resulting from combustion are removed by mechanical means continuously or periodically.

In conformity with the invention and according to the embodiment represented, the plate (1) is mobile with respect to the supply device (2) and/or to the ash-discharging device (3): it rotates, or can rotate, on its theoretical central axis (e1). See FIG. 3.

Any solution used to achieve the rotation of the plate (1) is indistinct, and is included in the object of the invention. In the example of embodiment represented, to achieve the rotation of the plate (1) a crown wheel (11) is arranged under it and occupying its entire perimeter; said crown wheel (11) engaging with one or several drive pinions that are operated by an external motor (neither the drive pinions nor the motor are represented).

In conformity with the invention and according to the embodiment represented, the ash-discharging device (3) is fixed and consists of at least one blade, (31) with means to guide it at will on the plate (1). Each ash-discharging device (3) rotates or can rotate on its theoretical axis (e2). See FIGS. 1 and 4.

Any solution used to achieve the rotation of the blades (31) is indistinct, and is included in the object of the invention. In the example of embodiment represented, to achieve the rotation of the blades (31) they are arranged jointly with a physical axis (30), to which a pinion (32) is also, arranged on a different plane. This pinion (32), engaging with one or several drive pinions (not represented), turns in one direction or the other, moves with it in its rotation on the physical axis (30) and causes the corresponding blade (31) to tilt in one direction or the other.

Figure 2A:
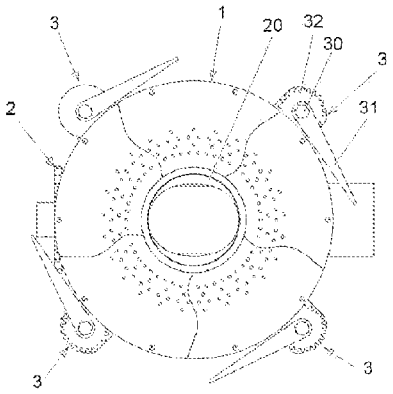
FIG. 2*a* represents an upper perspective view corresponding to the foregoing figure and with the blades (31) in a starting position, before starting the cleaning of the plate (1).
Figure 2B:
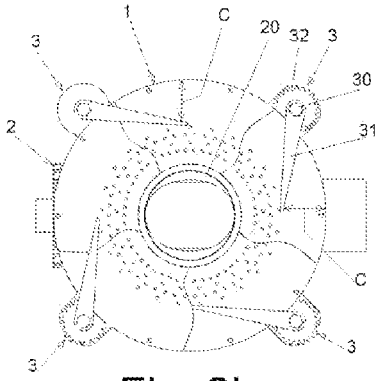
FIGS. 2*b* and 2*c* each represent upper perspective views similar to FIG. 2*a*, for respective positions in which the blades (31) clean by sweeping a crown (C) of any width (FIG. 2*b*) and a maximum crown ($C_m$) (FIG. 2*c*).
Figure 2C:
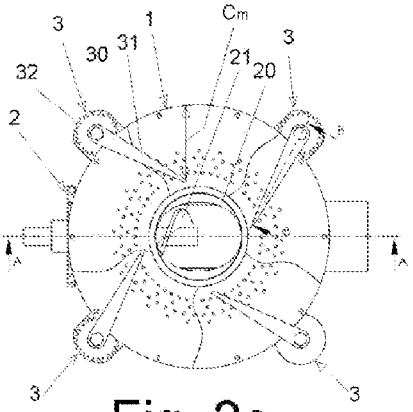
Figure 5A:
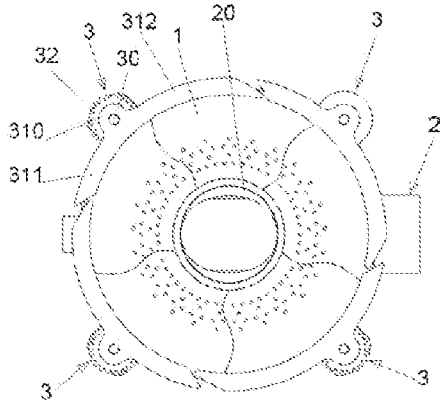
FIGS. 5*a*, 5*b* and 5*c* each represent similar upper perspective views, respectively, of FIGS. 2*a*, 2*b*, 2*c* for the embodiment of FIG. 4.
Figure 5B:
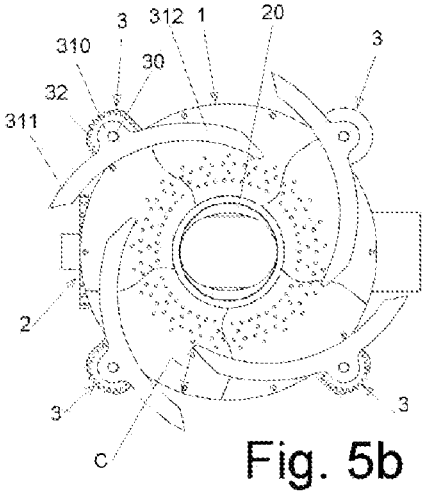
Figure 5C:
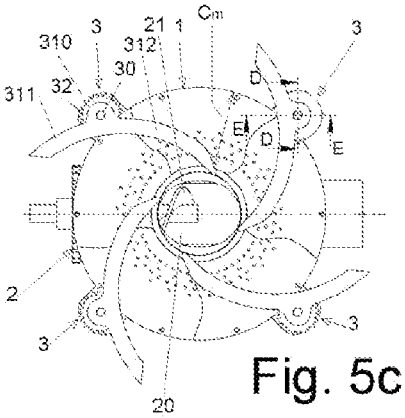
Figure 6:
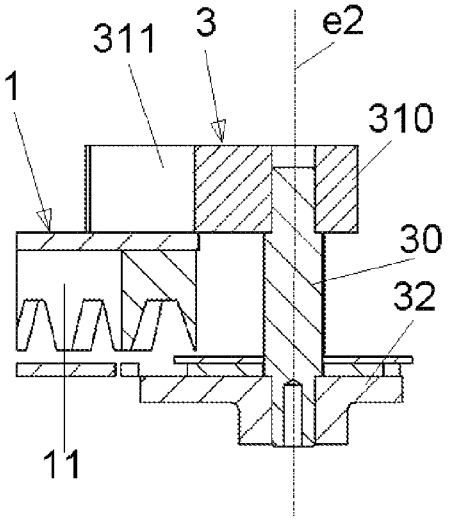
FIG. 6 represents a cross-section in detail according to indication E: E of FIG. 5*c*.
Figure 7:
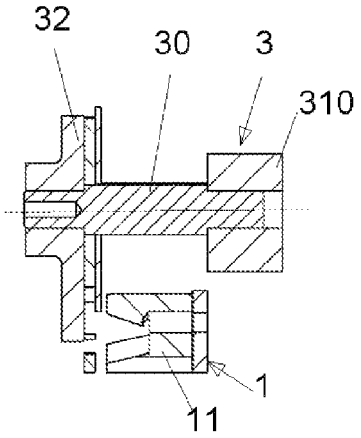
FIG. 7 represents a section in detail, according to indication D: D of FIG. 5*c*.

The blades (31) are arranged on the plate (1) and occupy its surface, starting from a tangential position, in which they occupy the perimetral zone of the plate (1)—see FIGS. 2*a* and 5*a*—to a radial position, in which they occupy the entire width of the plate (1)—see FIGS. 2*c* and 5*c*—.

Figure 3:
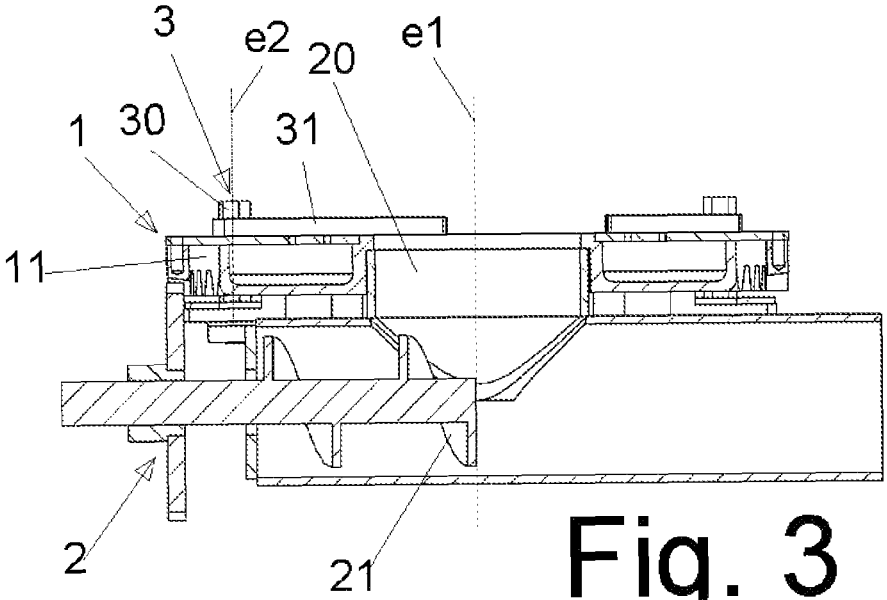
FIG. 3 represents a general cross-section according to indication A:A of FIG. 2*c*.
Figure 4:
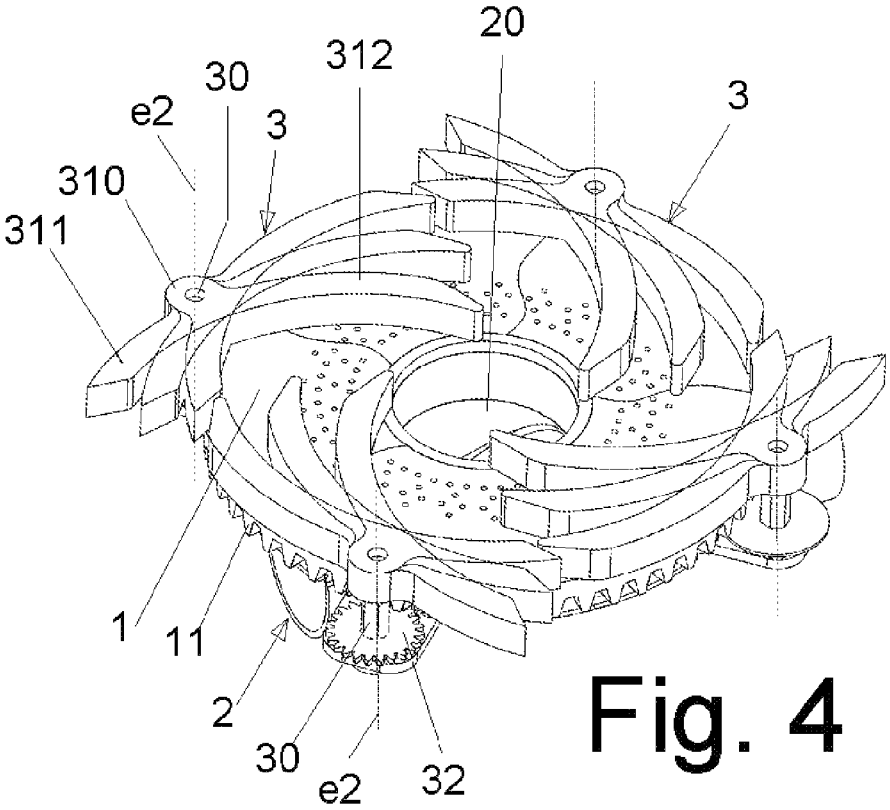
FIG. 4 represents a general view in perspective similar to FIG. 1 for an alternative embodiment, in which the blades (31) are increased in height and each of the blades (311), (312) appear from a central head (310).

Any geometry of the blades (31) is indistinct, and is included in the object of the invention, as well as any arrangement of the theoretical axis (e2) on which the blades (31) rotate:

in the example of embodiment represented in FIGS. 1 to 3 the blades (31) present planar configuration of low height and start radially from an end head and the theoretical axis (e2) on which they rotate is arranged on said end head;

in the example of embodiment represented in FIG. 4 and subsequent figures, the blades (31) present curved configuration and are increased in height. Each blade (31) is structured on a central head (310) from which each of the curved wings (311), (312) start radially and the theoretical axis (e2) on which they rotate is arrange on said end head. (310).

In a tangential starting position, represented in FIGS. 2*a* and 5*a*, the blades (31) are arranged on the perimeter of the plate (1), without interfering its surface or performing cleaning.

To clean the plate (1), according to the system that is the object of the invention, it is caused to rotate; in this case counter-clockwise, so that the blades (31) are arranged on the surface of the plate (1) occupying a crown (C) of any width and clean by sweeping the ashes on the surface delimited by said crown (C).

Depending on the width of said crown (C) the swept surface will be larger or smaller: starting from an initial limit position—represented in FIGS. 2*a* and 5*a*—the blades (31) rotate so that they can sweep a crown (C)—represented in FIGS. 2*b* and 5*b*—whose width varies from a minimum width in initial limit position in which the end of the blades (31) is very near the edge of the plate (1) to a final limit position in which the end of the blades (31) is very near the centre of the plate (1) sweeping a maximum crown ($C_m$)—represented in FIGS. 2*c* and 5*c*—which corresponds to the entire surface of the plate (1).

In addition, and according to the example of embodiment represented in FIG. 4 and subsequent figures, the blades (31) are increased in height and present asymmetric arrangement, defined by said central head (310) from which said curved wings (311), (312) start. In the initial position, corresponding to FIG. 5*a*, these blades (31) as a group define a wall that accompanies the plate (1) perimetrally and, being increased in size, delimit a perimetrally closed container to confine the solid fuel; so that the plate (1) accepts a larger quantity of fuel without varying its size.

From the basic concept described, any embodiments that do not essentially alter, change or modify the proposal are included in the object of the invention: For example, the number of blades (31) used is indistinct for the purposes of the invention although, for functionality, symmetry and ease of construction, in the examples of embodiment described four blades (31) have been represented.

The materials, dimensions, proportions and, in general, those other accessory or secondary details that do not essentially alter, change or modify the proposal may be variable.

The terms in which this report is written are a true reflection of the object described, and must be taken in their broadest sense and never in a limiting manner.

The invention claimed is:

1. A system for cleaning a burner and confining fuel in solid-fuel boilers comprising a circular plate of the burner associated with a combustion chamber, the circular plate having a center and a circular perimeter, the circular plate being mobile and rotating on a central axis of the plate;

a fuel supply device that supplies solid fuel from a storage hopper to the center of the plate through an intake line using controlled/automated dosing; and multiple ash-discharging devices fixed around the perimeter of the circular plate comprising multiple curved blades, each curved blade comprising a central head having a central axis and two curved wings extending radially out from the central head, the curved blade rotating on the central axis to continuously reach any position between a tangential one in which the multiple curved blades are arranged on the perimeter of the plate and a radial in which the blades are arranged on the entire width of the plate so that the blades can clean by sweeping the ashes deposited that occupy a crown (C) of any width between a minimum that corresponds to the edge of the plate and a maximum ($C_m$) which corresponds with the entire width of the plate.

2. The system according to claim 1, wherein the ash discharging devices jointly occupy the entire perimeter of the plate and the curved wings act as side slats in the aforementioned tangential position in which they are arranged on the perimeter of the plate all of them delimiting, in conjunction with the plate and in that tangential position, a perimetrally closed container to confine the solid fuel; so that the plate accepts a larger quantity of fuel without varying its size.

3. The system according to claim 1, wherein the system comprises four ash-discharging devices and four curved blades.

4. The system according to claim 1, wherein the two curved wings of the curved blade are asymmetrical in length.

* * * * *